US005155968A

United States Patent [19]

Mosse et al.

[11] Patent Number: 5,155,968

[45] Date of Patent: Oct. 20, 1992

[54] CONTINUOUS TO INTERMITTENT FEEDING INTERFACE

[75] Inventors: Richard W. E. Mosse, London, England; Sven O. S. Stark, Ystad, Sweden

[73] Assignee: Tetra Pak Holding & Finance, SA, Pully, Switzerland

[21] Appl. No.: 599,809

[22] Filed: Oct. 22, 1990

[30] Foreign Application Priority Data

Oct. 26, 1989 [GB] United Kingdom ..... 8924078

[51] Int. Cl.[5] ..... B65B 43/26

[52] U.S. Cl. ..... 53/64; 53/564; 53/389.1; 53/375.6; 493/315

[58] Field of Search ..... 53/64, 564, 566, 389.1, 53/371.8, 375.6, 376.8; 271/12; 414/798.9; 493/315, 317

[56] References Cited

U.S. PATENT DOCUMENTS

| | | | |
|---|---|---|---|
| 2,325,774 | 8/1943 | Hohl | 271/12 |
| 2,601,481 | 6/1952 | Williams | 493/315 |
| 2,611,299 | 9/1952 | Rose | 493/315 X |
| 2,671,385 | 3/1959 | Johenning | 53/564 X |
| 3,060,654 | 10/1962 | Lubensky | 53/564 X |
| 3,420,037 | 1/1969 | Villemure . | |
| 3,633,470 | 1/1972 | Pitters | 493/315 X |
| 3,937,458 | 2/1976 | Langen | 271/95 |
| 4,376,618 | 1/1983 | Focke | 53/233 X |
| 4,642,975 | 2/1987 | Langen | 53/564 |
| 4,871,348 | 10/1989 | Konaka | 493/315 |

FOREIGN PATENT DOCUMENTS

| | | |
|---|---|---|
| 2923909 | 12/1980 | Fed. Rep. of Germany . |
| 2053133 | 2/1981 | United Kingdom . |

*Primary Examiner*—John Sipos
*Attorney, Agent, or Firm*—Nixon & Vanderhye

[57] ABSTRACT

Apparatus for feeding items (10) such as flattened carton blanks from a magazine (12) for subsequent handling and treatment, comprises a transfer turret (16) mounted for continuous rotation adjacent the mouth (14) of the magazine, transfer stations (50) on the turret positioned to pass the mouth of the magazine and comprising means (6, 54, 56) for removing a said item (10) from the mouth of the magazine (12), erecting the item if it is a blank, and for carrying the said item as the turret rotates, an endless pocket conveyor (30), for receiving said items from said turrent, positioned adjacent said turret so as to be passed by the or each said transfer station as the turret rotates so as to produce a sequence of transfer station/conveyor interactions, and a globoidal cam indexing box (37) for driving said conveyor around an endless path in an intermittent motion in which said conveyor is halted for a period and is restarted in motion during intervals between at least selected sequential ones of said transfer station/conveyor interactions such that the distance travelled by the conveyor during decelerating to a stop and accelerating back to normal running speed is equal to the length of one pocket (32) on the conveyor.

20 Claims, 9 Drawing Sheets

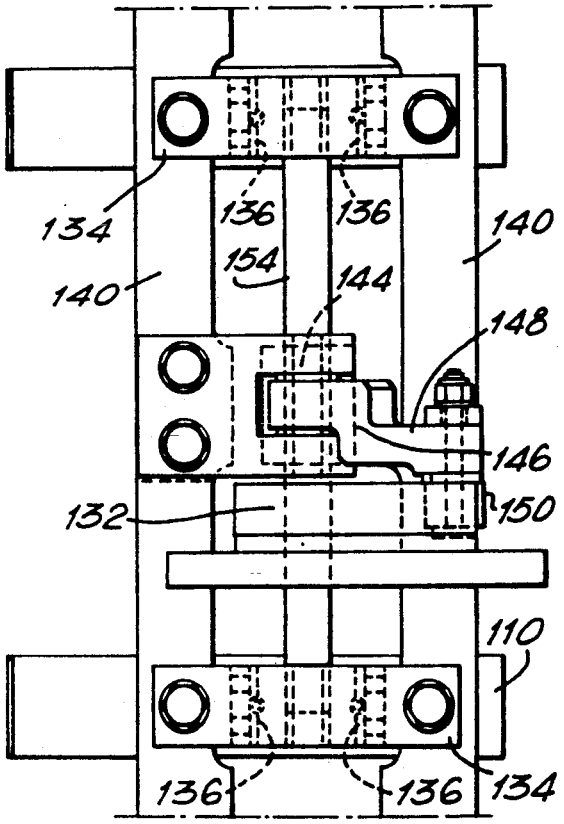
FIG.11.
FIG.12.
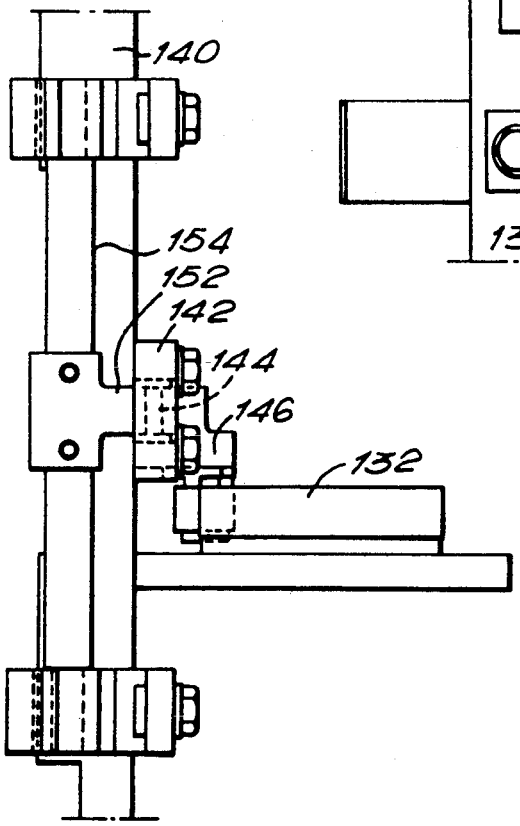

CONTINUOUS TO INTERMITTENT FEEDING INTERFACE

The present invention relates to apparatus for feeding items from a magazine in which the items are removed from the magazine's mouth by a continuously rotating transfer turret from which they are transferred to an intermittently rotating endless conveyor.

The invention has particular but not exclusive relevance to the feeding of carton blanks from a magazine to a filling machine In a conventional carton filling machine, preformed flattened, tubular carton blanks are removed from a magazine by a rapidly rotating transfer turret having a series of arms equipped with means for picking up the next carton blank from the magazine, erecting it to an open tubular configuration, and depositing it on a continuously moving endless conveyor member. The carton blanks are then processed in a continuous manner to fill them with dry contents. In such a system it is generally not feasible to seal the carton blanks so that they are capable of receiving liquid contents in a economic manner because of the continuous motion of the carton blanks.

Systems conventionally used for filling cartons with liquid contents involve intermittent motion of the carton blanks to allow operations such as bottom sealing to be carried out while the blanks are stationary. It has not previously been possible in an economic manner to feed carton blanks at a high rate such as 200 cartons per minute from a magazine to such an intermittently operating filling system.

A higher rate of feeding from the or each magazine of such a filling apparatus is desirable because the higher the feeding rate, the fewer the magazines which need be provided. Having fewer magazines is advantageous from a number of points of view. For instance, in a aseptic filling apparatus, the problem of keeping the magazine area aseptic is reduced.

The present invention provides apparatus for transferring items from a magazine using a continuously moving transfer device which transfers them to an intermittently moving receiving device.

The invention provides apparatus for feeding items from a magazine for subsequent handling and treatment, comprising a magazine for containing a series of said items, said magazine having a mouth at which in use said items may be sequentially removed from the magazine, a transfer turret mounted for rotation adjacent the mouth of the magazine, at least one transfer station on the turret positioned to pass the mouth of the magazine when the turret is rotated, the or each transfer station comprising means for removing a said item from the mouth of the magazine as the station passes the mouth of the magazine and for carrying the said item as the turret rotates, means for driving said turret for continuous rotation, an endless conveyor for receiving said items from said turret, positioned adjacent said turret so as to be passed by the or each said transfer station as the turret rotates so as to produce a sequence of transfer station/conveyor interactions, means for depositing a said item from the or each transfer station on to the conveyor when the transfer station holding said item passes said conveyor in a said transfer station/conveyor interaction, and means for driving said conveyor around an endless path in an intermittent motion in which said conveyor is halted for a period and is restarted in motion during intervals between at least selected sequential ones of said transfer station/conveyor interactions.

The transfer turret may comprise a plurality of transfer stations.

Preferably there are at least three transfer stations, these being positioned around the transfer turret so as to be angularly equi-spaced within a sector of the turret.

Preferably, the sector within which the transfer stations lie has an included angle of less 180°.

There may for instance be four transfer stations spaced one from another by equal angles from 30° to 60°.

The term "endless conveyor" is to be understood to include any conveying means in which conveying locations on the conveyor follow an endless path and includes not only conveyor belts but also rotary conveyor means such as turret conveyors.

The conveyor may define an endless sequence of locations each for receiving a said item, and the motion of the conveyor may be synchronised to the motion of the transfer turret so that a said location on the conveyor is correctly positioned to receive an item from the transfer turret at each said transfer station/conveyor interaction.

Such locations may for instance be defined by pockets provided on the conveyor.

The conveyor may be decelerated to a halt and thereafter accelerated to a constant running speed during said intervals between transfer station/conveyor interactions, such that the distance travelled by the conveyor during the deceleration added to the distance travelled by the conveyor during the acceleration is equal to the length in the direction of the conveyor path of a whole number of said locations, for instance, one location.

This will result in locations on the conveyor loaded with the items in question being spaced from one another by one or more empty locations.

The intermittent motion of the conveyor may suitably be derived from a continuously rotating mechanical drive to the conveyor via the action of a globoidal cam indexing box. The rotating drive to the cam indexing box may be mechanically linked to the means for driving the turret. For instance, they may share a common source of rotary drive to which they are connected by drive chains or toothed belts or through gear trains.

By this means, strict synchronisation between the movement of the transfer turret and the conveyor is achieved without expense of electronic control.

The magazine is preferably adapted to contain a series of tubular carton blanks in a flattened condition, and said transfer turret preferably includes means for erecting each said flattened blank during the blank's residence in the or its respective transfer station.

Such erecting of the carton blanks during their transit around the transfer station may be achieved using the principles explained in U.S. Pat. No. 3,937,131.

More particularly, the transfer turret may comprise a stationary endless cam track enclosing the axis of rotation of the turret and the or each transfer station may include a cam follower following said cam track connected to a lever means which bears against a carton blank held in said station in use, the cam track being so shaped as to produce movement of said lever means to force said carton blank into an erected tubular condition as the turret rotates said the or the respective transfer station between said magazine and said conveyor.

The or each transfer station may include a suction head (i.e. one or more suction heads) connected via a control means to a source of vacuum and positioned to engage and hold a face of a said carton blank to hold the blank in the transfer station.

The lever means may be mounted behind said suction head with respect to the direction of turret rotation.

Preferably there is further provided means for pre-bending a blank held by said carrying means of the or each transfer station prior to the erecting thereof, such that the blank is bent about a longitudinally running line toward the said transfer turret to facilitate subsequent erecting of the blank.

Preferably, said pre-bending means is a rotary member having at least one radial protrusion which in use bears against a portion of a blank held by said carrying means to bend the blank about said longitudinally running line.

Optionally, the magazine comprises an exit window for blanks, the width of which window constitutes a feed gap for restricting the feeding of blanks from said magazine such that only one blank is fed therethrough at a time, and means for momentarily widening said feed gap in synchrony with the feeding of a blank from said magazine to facilitate passage of a thickened portion of said blank.

The pre-bending means may be a pre-bend member provided adjacent the path of rotation of the transfer station(s), preferably immediately downstream from the magazine mouth, adapted to bear against a trailing portion of a carton blank and to bend the same about a preformed crease or score line in the blank to facilitate subsequent opening of the blank to a tubular form. Preferably, the pre-bend member is a pre-bend roller mounted for rotation about an axis parallel to that of the transfer turret and having a profile including one or more radially protruding lobes, the rotation of the pre-bend roller being synchronised to that of the transfer turret to cause such lobe or lobes to bear against the trailing part of a blank carried at the or each transfer station as the transfer station passes the pre-bend roller.

The rotary drive to the pre-bend roller may be directly mechanically connected to the rotary drive of the transfer turret through toothed drive belts or drive chains or through a gear train.

The stationary cam track of the transfer turret may include a movable portion adjacent the mouth of the magazine, the movable portion being movable between an extended and a retracted position such that in the extended position the transfer station(s) are guided to engage carton blanks in the magazine mouth in use whilst in the retracted position, the transfer station(s) are guided along a path in which they do not engage blanks in the magazine mouth in use.

Means may be provided to detect the presence or absence of blanks in the magazine and to provide a signal indicative of the presence or absence of blanks. Means responsive to said signal may be connected to the movable part of the cam track to shift the cam track appropriately between the advanced and retracted positions so that when no blanks are present, the cam track is in the retracted position.

Manual override means may be provided to allow an operator to shift said movable portion of the cam track out of the extended position.

The invention will be illustrated by the description of a preferred embodiment with reference to the accompanying drawings in which.

Figure 1:
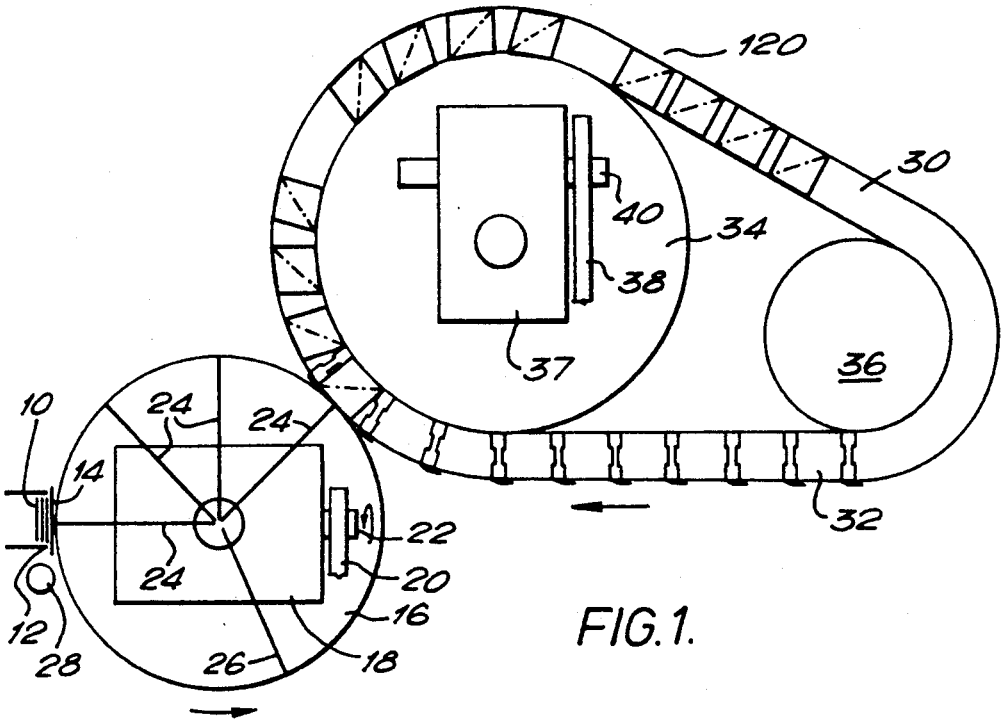
FIG. 1 is a perspective plan view of apparatus according to the invention.
Figure 10:
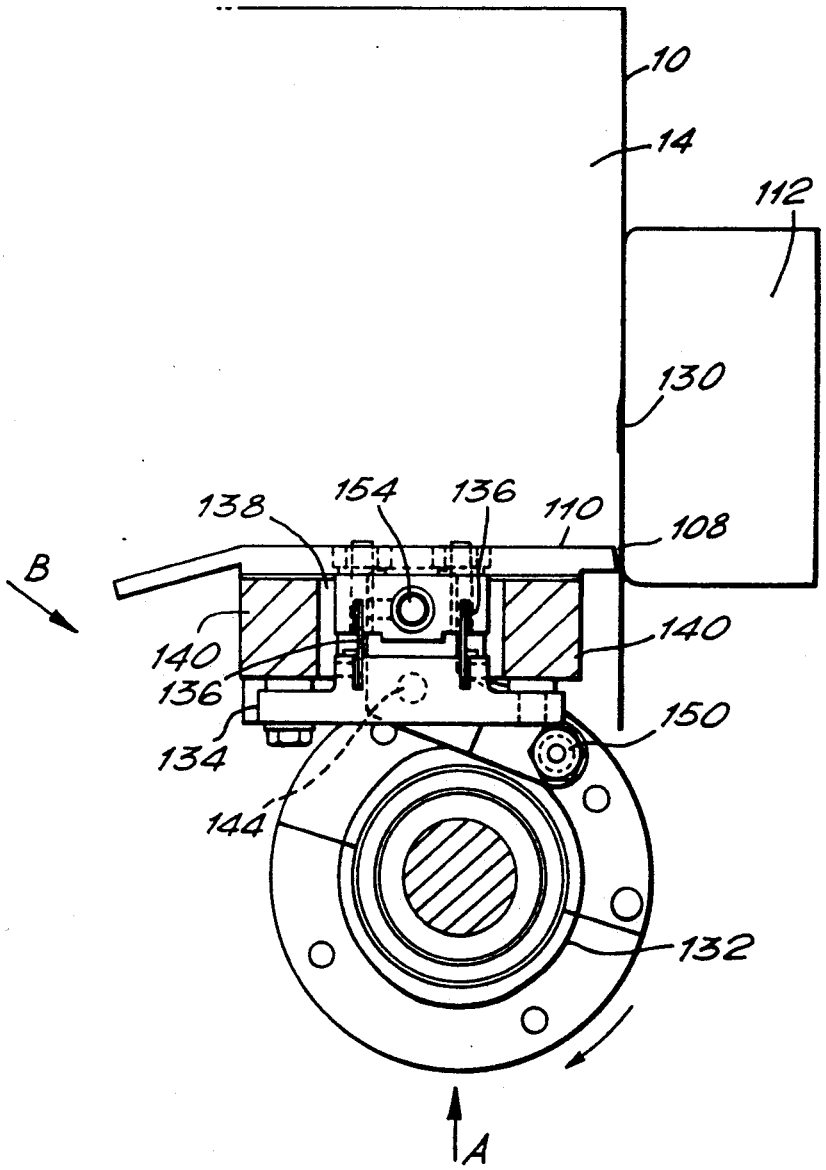
FIG. 10 shows in sectional plan view means for momentarily widening the feed gap of the magazine of FIG. 9.

FIG. 11 is a side elevation along the arrow A in FIG. 10, certain components being omitted for clarity; and FIG. 12 is an elevation along the arrow B in FIG. 10, certain components being omitted for clarity FIG. 1 shows a general schematic view of apparatus according to the invention. In FIG. 1, tubular carton blanks 10 in a flattened condition are stacked in a magazine 12 having a mouth 14 through which they may be sequentially removed.

In front of the mouth of the magazine is a transfer turret 16 mounted for rotation on a gear box 18 to which a rotary drive is provided by a toothed drive belt 20 passing over a drive pulley on an input shaft 22. The transfer turret has four arms 24, each of which at its free end has a transfer station as described in greater detail hereafter with reference to FIG. 3 and FIG. 5. A fifth arm 26 carries a counter-weight balancing the turret for rotation.

Adjacent the periphery of the transfer turret and immediately downstream of the mouth 14 of the magazine is a pre-bend roller 28 described in more detail with reference to FIG. 4.

An endless conveyor 30 divided into a continuous sequence of pockets 32, not all of which are shown but which extend all the way around the conveyor, lies adjacent the transfer turret. The conveyor path is defined by a larger wheel 34 and smaller wheel 36, the larger wheel being driven for intermittent rotation through a globoidal cam indexing box 37 by a continuously driven toothed drive belt 38 passing over a pulley mounted on an input shaft 40. Drive belts 20 and 38 may be driven from a common source of rotary drive so as to achieve the required synchronisation of the rotation of the transfer turret and the driving of a conveyor 30.

The general scheme of operation of the apparatus is that the transfer stations carried by each arm 24 sequentially strip from the mouth of the magazine 14 a carton blank 10. This is acted upon by the pre-bend roller 28 as described later, is erected to an open tubular form during its passage around the periphery of the transfer turret and is deposited in a respective pocket 32 of the conveyor 30. Four pockets are filled in sequence. During the period of time which elapses between the passage of the last of the arms 24 and the repassage of the first of the arms 24 at the tangential meeting of the transfer turret and the conveyor, the conveyor is decelerated to a halt to allow apparatus not shown to act upon a set of four carton blanks already deposited and is then accelerated back to its normal running speed. The deceleration and acceleration are at such a rate that the distance travelled by the conveyor during the period of deceleration and acceleration in aggregate is equivalent to a single pocket of the conveyor 30, or less preferably to an integral number of pockets greater than one.

The functioning of the components of the apparatus will now be described in greater detail.

Figure 9:
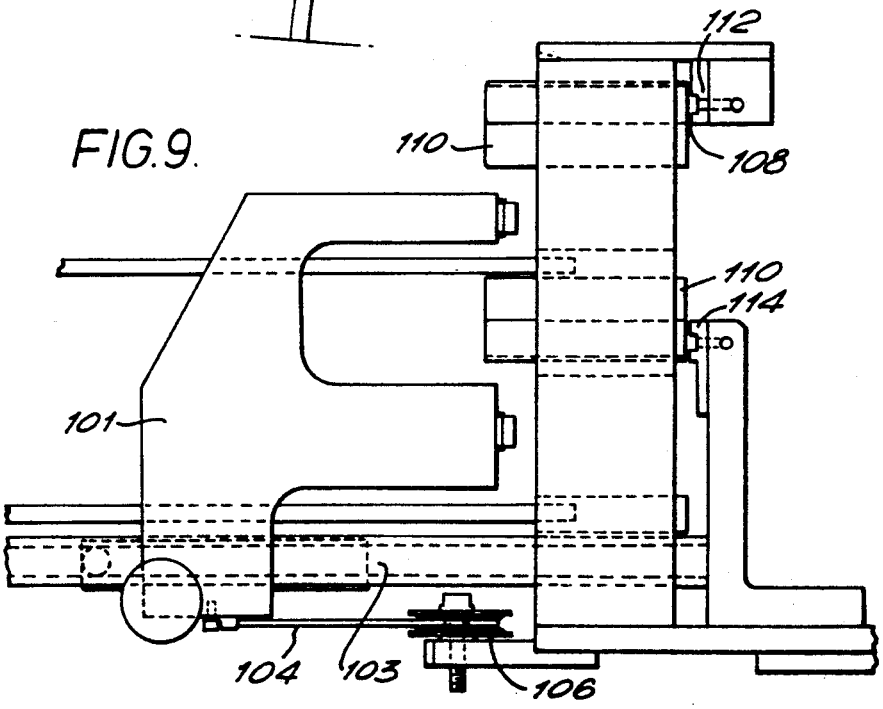
FIG. 9 is a side elevation view of the mouth of the magazine from which flattened blanks are taken for erection.

Blanks in a flattened condition are stored in a magazine of the kind shown in FIG. 9. A pusher 101 pushes a stack of blanks along a stack 103 pulled by a cable 104 attached via a pulley 106 to a counterweight, not shown.

At the magazine mouth, a narrow feed gap 108 constituting a metering gate permitting the exit of one blank at a time is defined between side plates 110 and hollow front stops 112, 114. Slots are formed in the abutment faces of the stops 112, 114 and a flow of air is induced through these slots by a fan or venturi means (not shown) into the hollow stops 112, 114. This air flow draws the front blank in the stack forward in the gate so as to position it correctly to be picked up and removed through the gate as next described.

This provides more reliable operation than relying on pressure on the back of the stack alone and on that pressure being transmitted through the stack uniformly. The risk of the trailing edge of the blank being misengaged or the leading edge jamming on the gate is much reduced.

Figure 2:
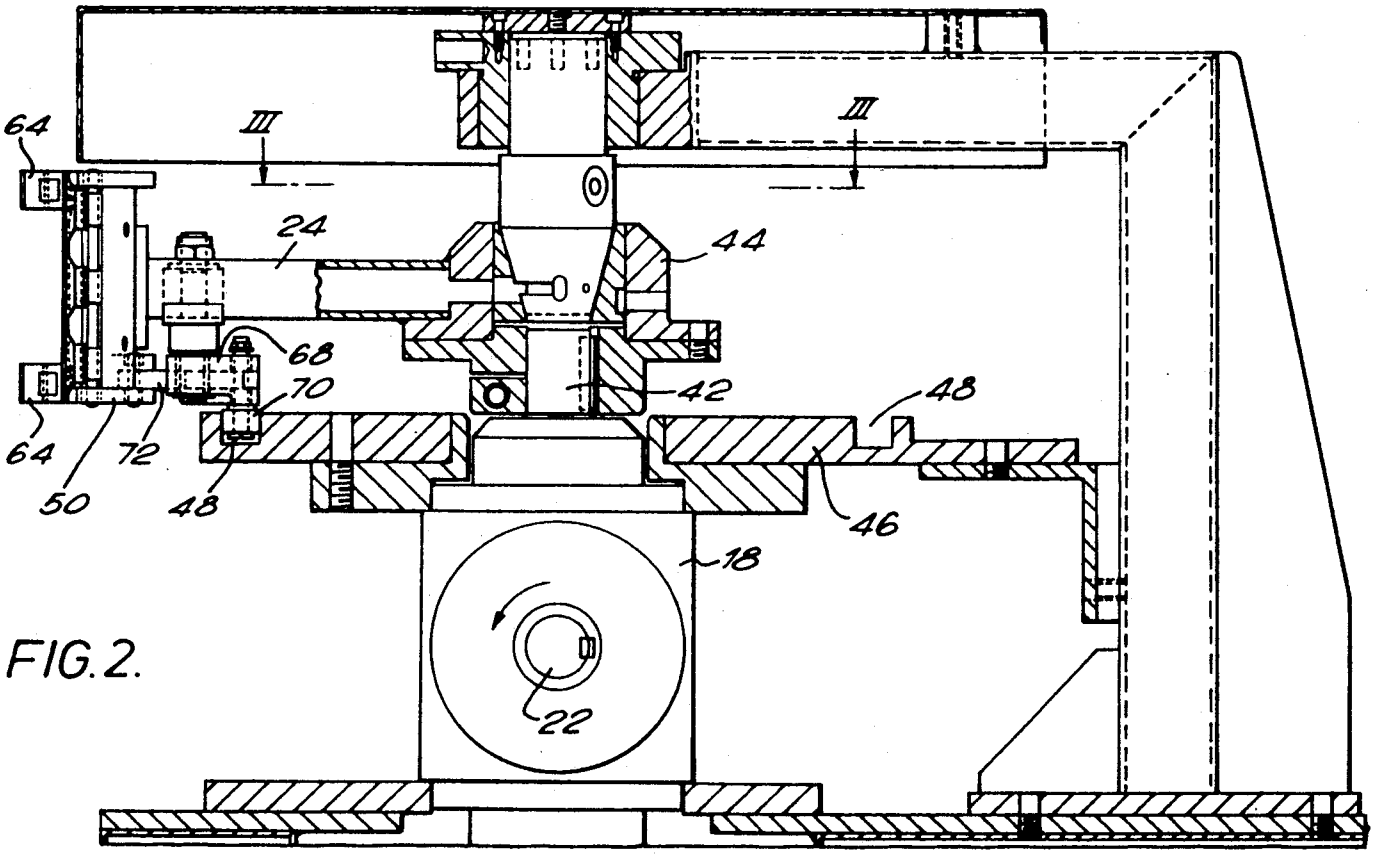
FIG. 2 is a side elevation of the transfer turret of the apparatus of FIG. 1.
Figure 3:
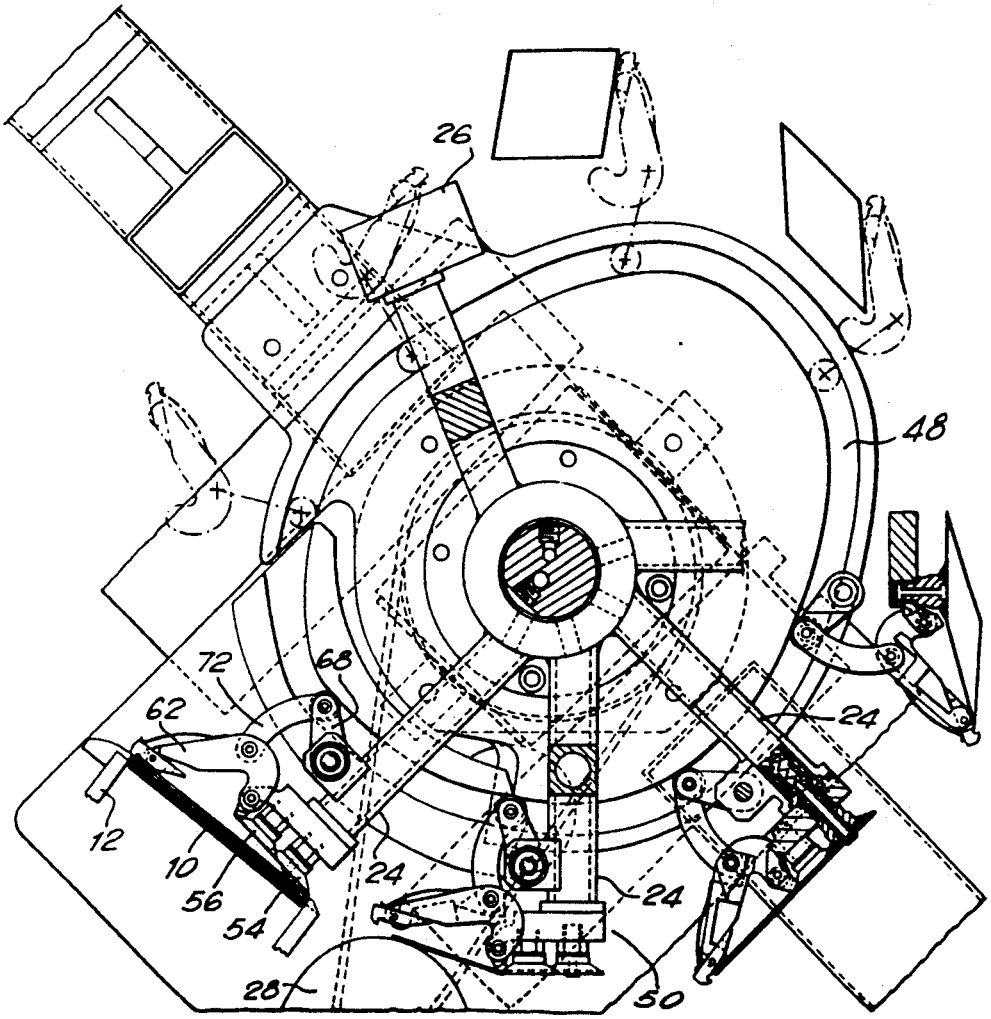
FIG. 3 is a plan view on the line III—III of FIG. 2 with certain components shown sectioned showing the operation of the transfer turret.

The transfer turret is shown in greater detail in FIG. 2 and FIG. 3. In FIG. 2, the transfer turret is seen to comprise the aforementioned gear box 18 from which rises a rotating output shaft 42 to which is mounted a central hub 44 bearing said arms 24 and 26. Fixed to the top of the gear box 18 is a cam plate 46 having a stationary cam path 48 enclosing the shaft 42.

The arms 24 are hollow and passages for the supply of compressed air and for the application of vacuum to the interior spaces of the arms 24 are provided in the shaft 42.

The arm 24 carries a respective transfer station 50 arranged to pass between the upper and lower front stops 112, 114 of the metering gate of the magazine. These are seen better in FIGS. 3 and 5.

Figure 5:
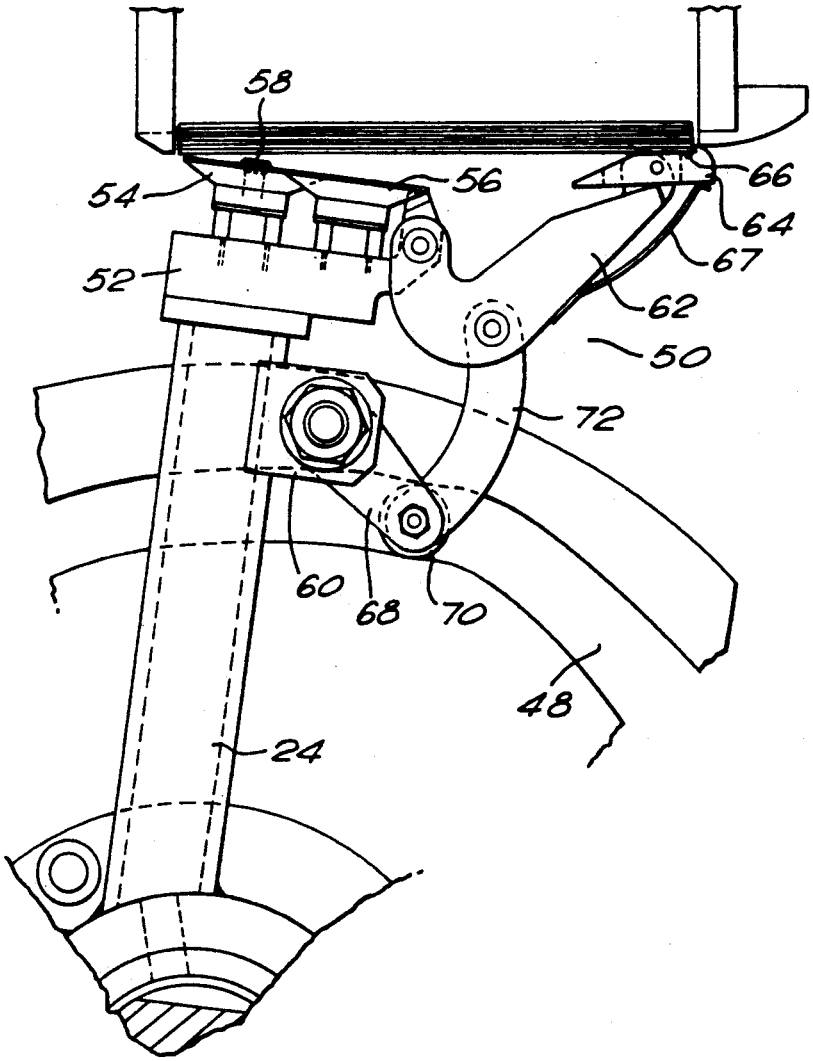
FIG. 5 is a plan view in greater detail of one transfer station of the transfer turret of FIG. 1.

As shown in FIGS. 3 and 5, each transfer station 50 includes a head 52 at the end of a respective arm 24 bearing a pair of suction cups 54, 56. Suction cup 54 is provided with an axially extending push rod 58 protruding through the center of the suction cup 54 and displaceable inwardly when the cup is pressed against a blank in use. Push rod 58 acts upon a valve not shown within the arm 24 to open the valve to communicate suction to the suction cups 54, 56.

Connected to the head 52 and to a lug 60 provided on the arm 24 is a lever means (62, 64, 68, 72) having a number of components as follows. A generally L-shaped first lever arm 62 is pivoted to the trailing edge of the head 52. At its free end it carries a pivoting shoe member 64 which has on its outer face a notch 66 acting as a hook to engage the trailing edge of a blank in the magazine mouth. The shoe member 64 is pivoted to the end of the first link arm 62 and is biased for anti-clockwise rotation by a leaf spring 67 fixed to the first link arm. A second link arm 68 is articulated to the lug 60 and carries a cam follower roller 70 located in the stationary cam path 48. A third link arm 72 is articulated to the roller carrying end of the second link arm 68 and to a point intermediate the ends of the first link arm 62 at the angle of the L of that arm.

Rotation of the arm 24 with consequent following of the cam path 48 by the cam follower 70 produces movements of the lever means constituted by the first, second and third link arms in the manner shown in FIG. 3. At the point of picking up a blank from the magazine mouth, the first link arm is rotated anti-clockwise outwardly to a point at which the notch 66 of the shoe member 64 will act as a hook to contact the trailing edge of a blank in the magazine mouth under the influence of the spring 67 against which it is resiliently deflectable back in the event of meeting an obstruction. The suction cup 54 contacts the face of the blank adjacent its forward edge and depression of the valve member 58 applies vacuum to the suction cups 54 and 56 so that the blank pushed out of the mouth of the magazine 12 by the shoe member 64 is taken up by the suction cups 54, 56. As the notch 66 is passed across the face of the magazine, the path of the notch is a straight line rather than the arc of a circle by virtue of the shape adopted for the cam track 48.

In the next rotational position shown moving in an anti-clockwise direction, the second link arm 68 has been rotated clockwise by the effect of the cam track 48 so that the first link arm has been retracted clockwise away from the blank providing clearance for the operation of the pre-bend roller 28 as described in greater detail with reference to FIG. 4 hereafter.

In the next rotational position moving anti-clockwise, the second link arm 68 has been rotated back again anti-clockwise to bring the first link arm back in an anti-clockwise direction to contact the trailing edge of the blank. In successive positions moving in an anti-clockwise direction, the second link arm 68 is further rotated in an anti-clockwise direction so that the first link arm at the point where it is articulated to the shoe member 64 progressively pushes the trailing edge of the blank up so that the blank is erected into an open tubular configuration and in the fifth position illustrated in FIG. 3 it can be seen that the blank has been pushed past its normal open configuration whilst in the sixth position it can be seen that the first link arm has been rotated back again in a clockwise direction sufficiently to allow the blank to relax back through a perfectly square configuration to a small degree.

The air passages within the shaft 42 are such that at this point the vacuum is cut off from the suction cups 54, 56 to release the blank. Compressed air may be supplied at this point to blow the blank off the suction cups.

Figure 4:
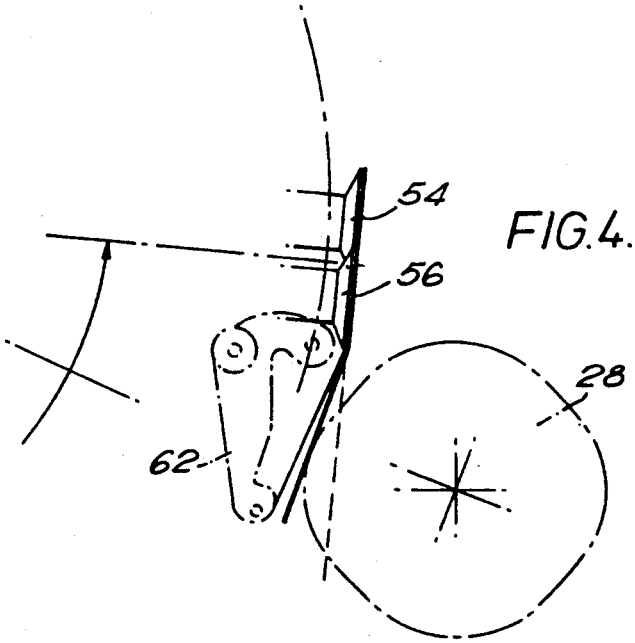
FIG. 4 is a plan view of the pre-bend roller of the apparatus of FIG. 1.

The pre-bend roller shown in FIG. 4 has the shape of a square with rounded off corners so that it is provided effectively with four radially protruding lobes. The function of the pre-bend roller is twofold. It makes half a revolution per blank. A first lobe presses the first panel of the carton blank firmly against the suction cups, while the second lobe, which is higher, pre-bends the trailing panels, relative to the leading panel which is now firmly held by the suction cups 54, 56 to bend that part back toward the axis of rotation of the transfer turret about preformed crease lines in the blank. The effect of this is that when the first link arm 62 is moved to engage the trailing part of the blank and to push it upwards, the blank opens and does not bend into an L-configuration.

The remaining two lobes of the pre-bend roller act on the following blank.

Figure 6:
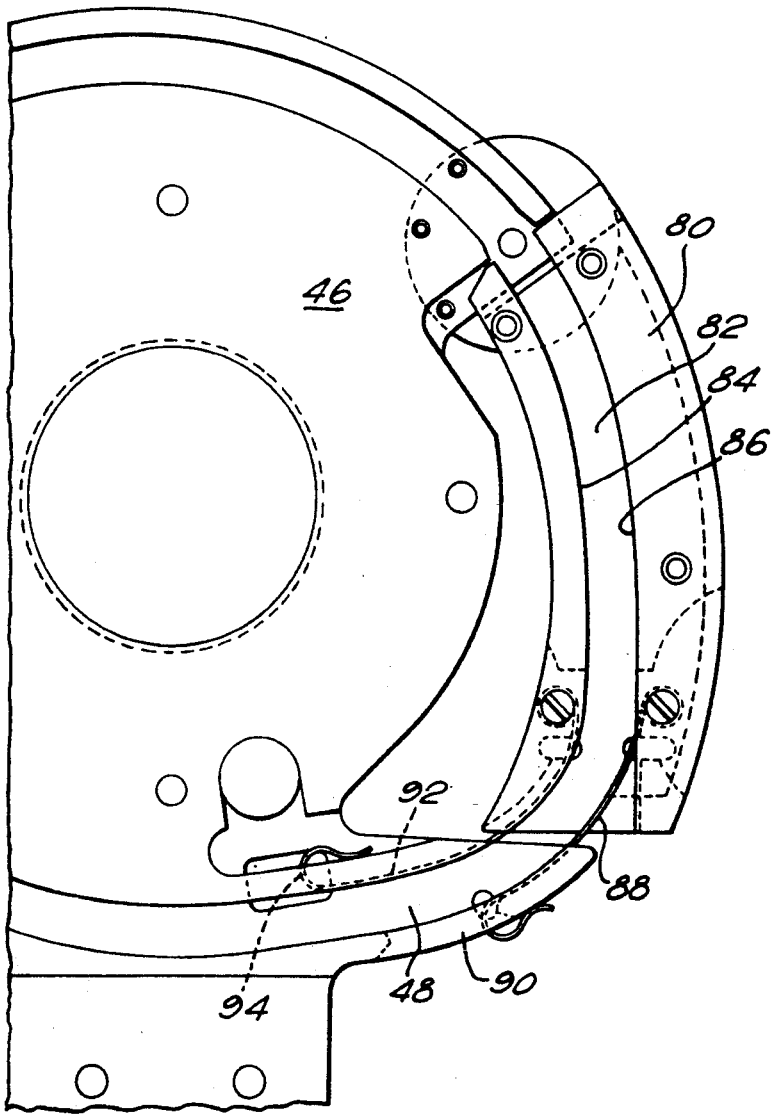
FIG. 6 is a plan view of a movable portion of the stationary cam track of the transfer turret of FIG. 2.

As shown in FIG. 6, the cam track 48 includes a movable portion. Over most of its length, the cam track is defined between opposed, fixed wall surfaces provided on the cam plate 46. Opposite the mouth 14 of the magazine 12 however, the fixed cam plate 46 is cut away and a movable cam plate portion 80 is provided articulated to the fixed cam plate 46 at its upstream end to provide a smooth junction. Cam plate portion 80 has running along its length a cam track portion 82 defined between opposed upstanding walls 84, 86. In the extended position of the movable cam plate portion 80 as shown in FIG. 6, a smooth junction between wall 86 and the corresponding wall defining the fixed cam path 48 is made by the provision of a leaf spring 88 fixed to the movable cam plate portion 80 at one end and sliding within a slot 90 provided in the adjacent part of the fixed cam plate portion 48 at its other end. Similarly, a smooth junction is made between wall 84 of the movable cam plate 80 and the corresponding wall of the fixed cam plate portion 48 by a leaf spring 92 fixed at one end to the cam plate portion 80 and sliding in a slot 94 in the inner wall of the fixed part of the cam track 48. The movable cam plate portion 80 can be retracted from the position shown in FIG. 6 by pivoting about its upper end in the figure under the influence of an actuator which is not shown. The actuator may for instance be a solenoid mounted on the cam plate 46 and connected to the movable cam plate portion 80 can be retracted from the position shown in FIG. 6 by pivoting about its upper end in the figure under the influence of an actuator which is not shown. The actuator may for instance be a solenoid mounted on the cam plate 46 and connected to the movable cam plate portion 80. An actuating input to the solenoid to produce retraction of the movable cam plate portion 80 is provided by a sensor in the magazine adapted to sense the absence of blanks to be fed. This may for instance be a microswitch depressed by a blank at the mouth of the magazine or may be an optical sensor.

The effect of retracting the movable cam plate portion 80 is that the second link arm 68 of each transfer station is not swung sufficiently outwards in an anti-clockwise direction about its articulation to the lug 60 of its respective arm 24 to bring the notch 66 of its shoe member 64 into position to try to engage a blank in the magazine when none is present.

Means may be provided for an operator to actuate the means to produce retraction of the movable cam plate portion 80 even in the presence of blanks in the magazine, for instance to allow the operator to clear a stoppage of blanks in the magazine.

Figure 7:
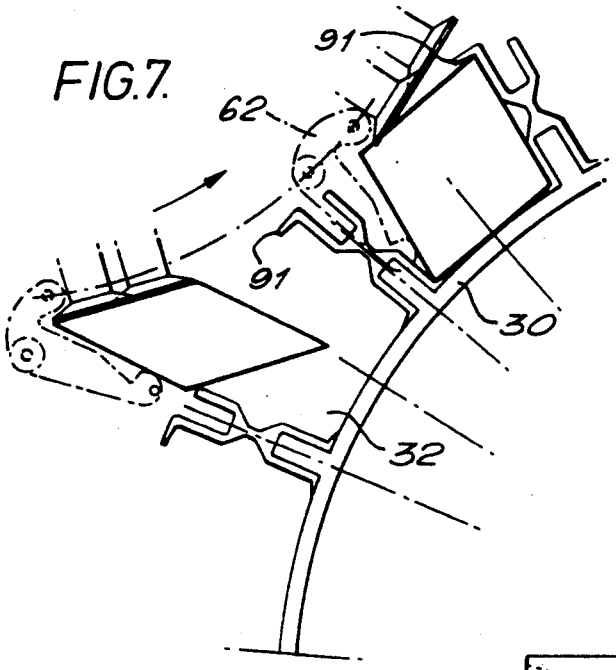
FIG. 7 is a plan view of the interacting portions of the transfer turret and conveyor of FIG. 1.

The form of the pockets of the conveyor 30 are shown in detail in FIG. 7. Each pocket is open at the top and bottom and is defined between side wall members extending outwardly from the vertical face of the conveyor 30. At the outward end of the leading wall defining each pocket is a short rearwardly trailing hook 91 under which comes to be located one corner of the erected blank. It can be seen that the blank in the first of the positions illustrated moving an anti-clockwise direction has been opened beyond its normal square configuration so as to adopt a diamond shape to allow it to be slipped into the pocket whilst in the second illustrated position, the first link arm 62 has been retracted to allow the carton blank to adopt a more nearly square configuration to fit snuggly in the pocket and to be retained in the pocket by the springiness of the material of the blank and by the action of the hook 91. The first link arm 62 passes beneath the wall members defining the pockets 32.

Figure 8:
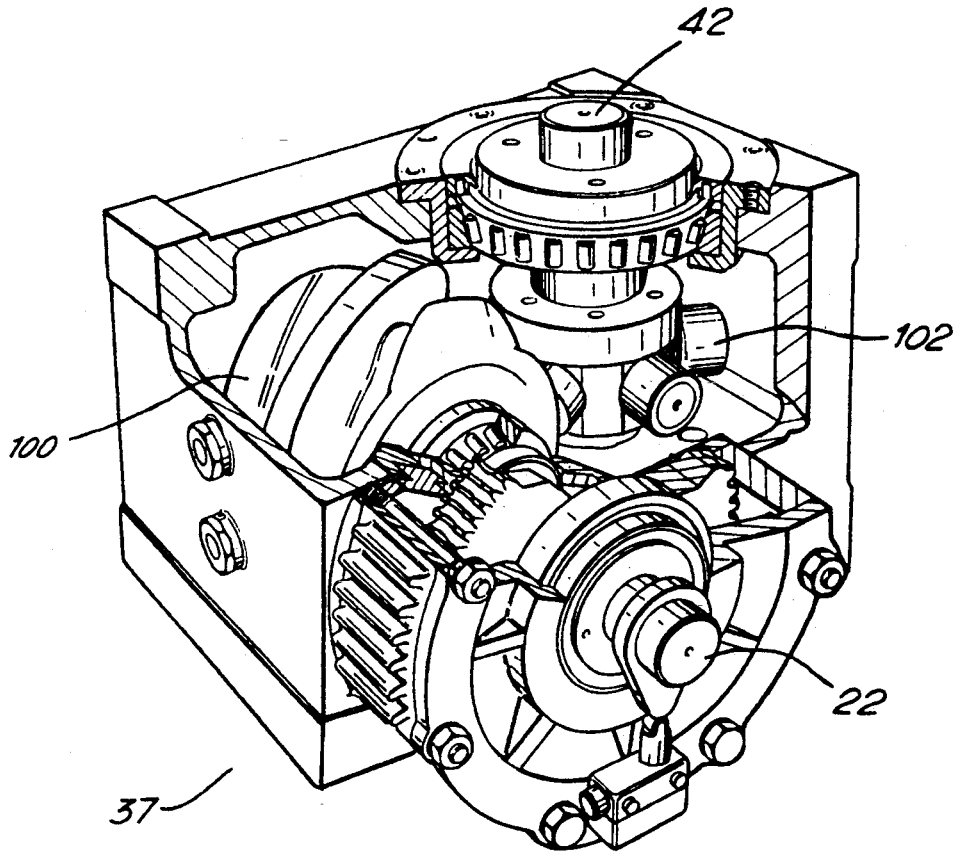
FIG. 8 is a cut-away perspective view of a typical globoidal cam indexing box of the kind used in the apparatus of FIG. 1.

The intermittent motion of the conveyor 30 is achieved using a globoidal indexing cam which may be generally of the kind shown in FIG. 8. A continuously rotating input at the shaft 22 rotates a worm-like cam member 100 which is engaged with cam followers 102 connected to the intermittently rotating output shaft 42. Each cam follower member 102 takes the form of a roller mounted for rotation on a radially projecting spindle. Depending upon the shape of the cam path of the cam 100, essentially any desired pattern of intermittent rotation may be achieved. In particular, it may be arranged that the conveyor 30 moves at a constant speed whilst receiving blanks from each of the arms 24 and then decelerates to a standstill for a period and this then reaccelerated to the aforesaid constant speed, the distance travelled by the conveyor 30 during the deceleration and acceleration being one pocket length. During the period whilst the conveyor 30 is stationary, a set of blanks may be removed from those pockets marked at 120 in FIG. 1 for subsequent processing and filling. During the course of the removal, it is possible if desired to carry out an operation on the blanks such as folding and sealing closures at one end of the blanks.

Flattened laminated card blanks for erection to form cartons have a longitudinally running seal of approximately double the carton wall thickness. In the high speed feeding of carton blanks from a magazine through the feed gap 108, there is a danger that the seal will snag in the feed gap causing a jam. The arrangement illustrated in FIGS. 10 to 12 is intended to counter this eventuality. As shown in FIG. 10, the blank 10 has a thickened seal portion 130 which has to pass through the feed gap 108. If the feed gap 108 is made too large, there is a danger that two blanks at once may try to pass through the feed gap and become jammed. On the other hand, if the feed gap 108 is made small to prevent this, there is a danger of the seal portion 130 snagging in the feed gap. In the arrangement described with reference to FIGS. 10 to 12, the feed gap is varied in width momentarily as each blank is fed. The gap being widened to allow passage of the seal portion 130.

The apparatus includes a rotary cam 132 mounted to rotate with the pre-break roller 28 about the same axis but vertically spaced therefrom. The pre-break roller 28 is omitted from FIGS. 10 to 12 so as to show the remainder of the structure. The side plates 110 of the magazine mouth are each mounted to a support 134 via leaf springs 136 mounted to the support 134 and to a carrier block 138 fixed to each respective side plate 110. Each support 134 is carried by a pair of vertically running columns 140 to which the supports 134 are bolted. The columns 140 lie between the supports 134 and the side plates 110 so that movement of the side plates 110 towards the supports 134 by deformation of the leaf springs is prevented. A limited amount of movement of the side plates 110 parallel to the supports 134 is permitted by the leaf spring mounting. As shown in FIG. 11, intermediate the upper and lower supports 134 a pivot pin support 142 is attached to the left-hand one of the columns 140 in the drawing. Pivot pin support 142 has a forked portion in which is carried a vertically running pivot pin 144. A bell crank 146 is pivoted on pivot pin 144. Bell crank 146 has a first arm 148 carrying at its free end a cam follower roller 150 which follows the periphery of the cam 132. Bell crank 146 has a second arm 152 best seen in FIG. 12 terminating in a cylindrical bush through which runs a vertical rod 154 which is connected at its upper and lower ends to the carrier blocks 138 of the side plates 110.

The cam 132 has two dimentrically opposed protruding lobes so that it deflects the cam follower roller 150 outwards twice per revolution, i.e. once for each blank. Through the action of the bell crank, the movement of the cam follower roller 150 is translated into a leftward shifting of the side plates 110 momentarily opening the feed gap 108 to allow the passage of a seal portion 130 of the blank 10.

The machine illustrated is capable of removing blanks at a rate of 200 blanks per minute from the magazine and transferring them to the intermittently moving conveyor 30 whilst the conveyor 30 is intermittently stopped for a period sufficient to allow the transfer of blanks from the conveyor four at a time for further treatment.

Although the invention has been described with reference to the embodiment specifically illustrated above, many modifications and variations are possible within the scope of the invention.

We claim:

1. Apparatus for feeding carton blanks items from a magazine for subsequent handling and filling with liquids, comprising a magazine for containing a series of said items, said magazine having a mouth at which in use said items may be sequentially removed from the magazine, a transfer turret mounted for rotation adjacent the mouth of the magazine, at least one transfer station on the turret positioned to pass the mouth of the magazine when the turret is rotated, the or each transfer station comprising means for removing a said item from the mouth of the magazine and for carrying the said item as the turret rotates, means for driving said turret for continuous rotation, an endless conveyor, for receiving said items from said turret, positioned adjacent said turret so as to be passed by the or each said transfer station as the turret rotates so as to produce a sequence of transfer station/conveyor interactions, means for depositing a said item from the or each transfer station on to said conveyor when the transfer station holding said item passes said conveyor in a said transfer station/conveyor interaction, and means for driving said conveyor around an endless path in an intermittent motion in which said conveyor is halted for a period at times other than during said transfer station/conveyer interactions and is restarted to move during said transfer station/conveyor interactions.

2. Apparatus as claimed in claim 1, wherein the transfer turret comprises a plurality of transfer stations.

3. Apparatus as claimed in claim 2, wherein there are at least three transfer stations, these being positioned around the transfer turret so as to be angularly equispaced within a sector of the turret.

4. Apparatus as claimed in claim 3, wherein said sector has an included angle of less than 180°.

5. Apparatus as claimed in claim 4, wherein there are four transfer stations spaced one from another by equal angles of from 30° to 60°.

6. Apparatus as claimed in claim 1, wherein the conveyor defines an endless sequence of locations, each for receiving a said item, and wherein the motion of the conveyor is synchronised to the motion of the transfer turret so that a said location on the conveyor is correctly positioned to receive an item from the transfer turret at each said transfer station/conveyor interaction.

7. Apparatus as claimed in claim 6, wherein said locations, are defined by pockets provided on the conveyor.

8. Apparatus as claimed in claim 6, wherein said conveyor is decelerated to a halt and thereafter is accelerated to a constant running speed during said intervals, such that the distance travelled by the conveyor during said deceleration added to the distance travelled by the conveyor during said acceleration is equal to the length in the direction of the conveyor path of a whole number of said locations.

9. Apparatus as claimed in claim 8, wherein said whole number is 1.

10. Apparatus as claimed in claim 1, wherein said intermittent motion of the conveyor is derived from a continuously rotating drive to the conveyor via the action of a globoidal cam indexing box.

11. Apparatus as claimed in claim 10, wherein said rotating drive to the conveyor is mechanically linked to said means for driving the turret.

12. Apparatus as claimed in claim 1, wherein said blanks are tubular carton blanks in a flattened condition, and said transfer turret includes means for erecting each said flattened blank during the blank's residence in the or its respective transfer station.

13. Apparatus as claimed in claim 12, wherein said transfer turret comprises a stationary endless cam track enclosing the axis of rotation of the turret and the or each said transfer station includes a cam follower following said cam track connected to a lever means which bears against a carton blank held in said station in use, the cam track being so shaped as to produce movement of said lever means to force said carton blank into an erected tubular condition as the turret rotates said the or the respective transfer station between said magazine and said conveyor.

14. Apparatus as claimed in claim 13, wherein the stationary cam track of the transfer turret includes a movable portion adjacent the mouth of the magazine, the movable portion being movable between an extended and a retracted position such that in the extended position the transfer station(s) are guided to engage carton blanks in the magazine mouth in use whilst in the retracted position, the transfer station(s) are guided along a path in which they do not engage blanks in the magazine mouth in use.

15. Apparatus as claimed in claim 14, including means to detect the presence or absence of blanks in the magazine and to provide a signal indicative of the presence or absence of blanks and means responsive to said signal connected to the movable part of the cam track to shift the cam track appropriately between the advanced and retracted positions so that when no blanks are present, the cam track is in the retracted position.

16. Apparatus as claimed in claim 13, wherein the or each transfer station includes a suction head connected via control means to a source of vacuum and positioned to engage and hold a face of a said carton blank to hold the blank in the transfer station.

17. Apparatus as claimed in claim 16, wherein the said lever means is mounted behind said suction head with respect to the direction of turret rotation.

18. Apparatus as claimed in claim 12, wherein there is further provided means for pre-bending a blank held by said carrying means of the or each said transfer station prior to the erecting thereof, such that the blank is bent about a longitudinally running line towards the said transfer turret to facilitate subsequent erecting of the blank.

19. Apparatus as claimed in claim 18, wherein said pre-bending means is a rotary member having at least one radial protrusion which in use bears against a portion of a blank held by said carrying means to bend the blank about said longitudinally running line.

20. Apparatus as claimed in claim 12, wherein the magazine comprises an exit window for blanks, the width of which window constitutes a feed gap for restricting the feeding of blanks from said magazine such that only one blank is fed therethrough at a time, and means for momentarily widening said feed gap in synchrony with the feeding of a blank from said magazine to facilitate passage of a thickened portion of said blank.

* * * * *